US005883055A

United States Patent [19]

Baca

[11] Patent Number: 5,883,055

[45] Date of Patent: Mar. 16, 1999

[54] BOWLING LANE OIL IN AEROSOL CONTAINER

[75] Inventor: Joseph Samuel Baca, Stockton, Calif.

[73] Assignee: Lane Masters, Incorporated, Stockton, Calif.

[21] Appl. No.: 878,438

[22] Filed: Jun. 18, 1997

Related U.S. Application Data

[63] Continuation-in-part of Ser. No. 835,940, Apr. 11, 1997.

[51] Int. Cl.[6] ..... C10M 101/00

[52] U.S. Cl. ..... 508/206; 508/371; 508/372; 508/390; 508/583; 510/214

[58] Field of Search ..... 508/206

[56] References Cited

U.S. PATENT DOCUMENTS

| | | | |
|---|---|---|---|
| 3,932,043 | 1/1976 | Joffre | 401/196 |
| 4,478,730 | 10/1984 | O'Connor | 252/34.7 |
| 5,534,173 | 7/1996 | Faber et al. | 508/203 |

*Primary Examiner*—Ellen M. McAvoy
*Attorney, Agent, or Firm*—Flehr Hohbach Test Albritton and Herbert

[57] ABSTRACT

Bowling lane conditioning oil in an aerosol container which has a propellant for dispensing the oil through a spray nozzle in an aerosol form. The oil includes a mixture of mineral oil, a leveling agent, and an antistatic agent. The mineral oil is a combination of paraffin and petroleum based mineral oils, and in some embodiments, the mixture also includes isopropyl alcohol, a fluorescent whitening agent, and a lubricity agent.

18 Claims, 1 Drawing Sheet

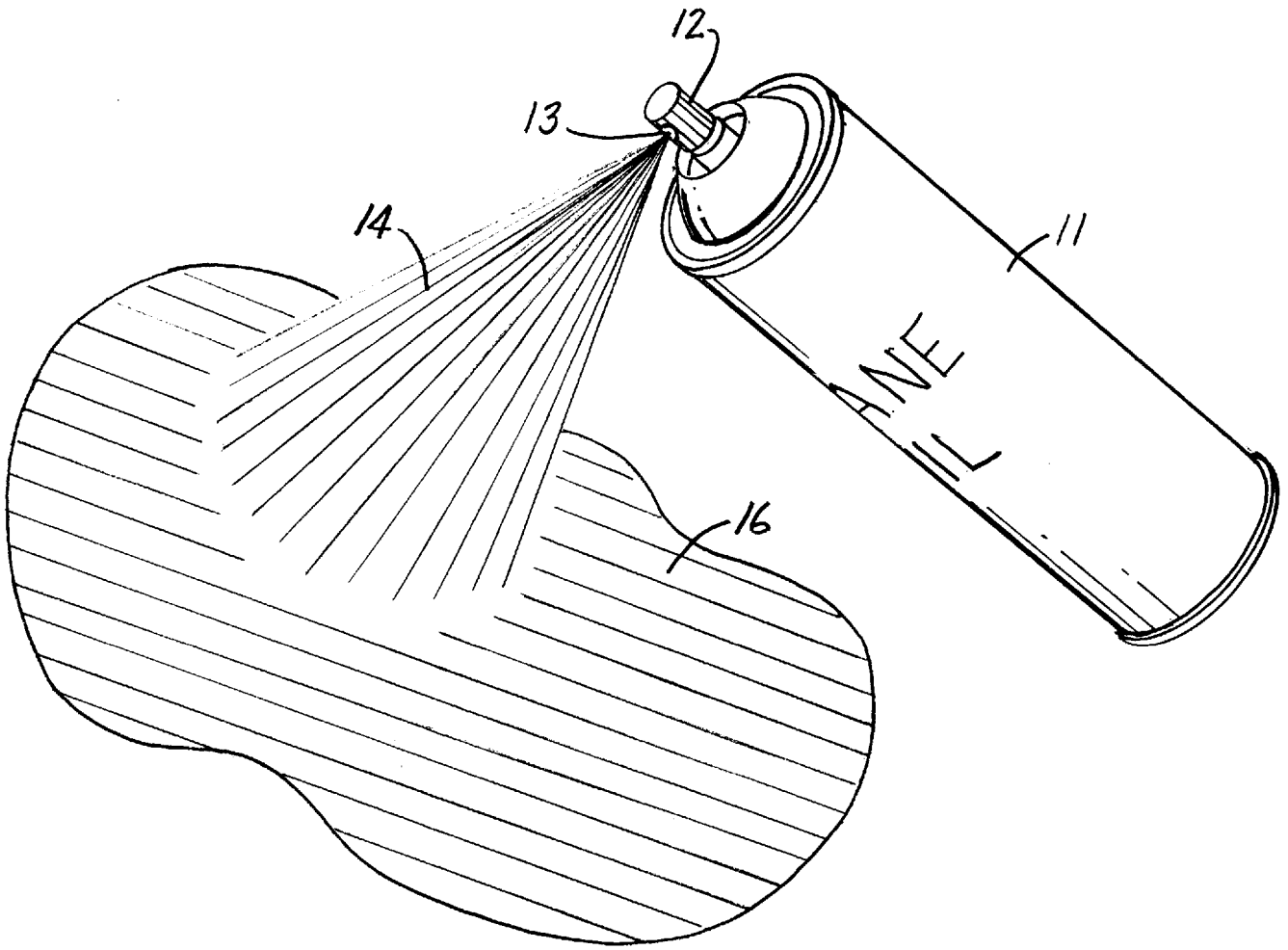
11
12
13
14
16

BOWLING LANE OIL IN AEROSOL CONTAINER

CROSS REFERENCE TO RELATED TO APPLICATION

This is a continuation-in-part of Ser. No. 08/835,940, filed Apr. 11, 1997, now pending.

BACKGROUND OF THE INVENTION

1. Field of the Invention

This invention pertains generally to the preparation and care of bowling lanes and, more particularly, to a conditioning oil for use on bowling lanes.

2. Related Art

Conditioning oil is applied to the surface of bowling lanes to provide proper ball action. The oil is applied to the head and center portions of each lane so that the ball will slide over them and then grip the surface as it approaches the pin deck.

The oil has a significant effect on the manner in which the ball travels down the lane, and proper oiling is very important for consistent action and scoring. If the oil gets picked up by the ball and carried down the lane or is pushed down the lane ahead of the ball, the oil can get onto the pin deck where it can cause the pins to slide around instead of falling. If the oil gets into the bail return machine, and it can gum the machine it up and interfere with its operation.

With too little oil, the ball does not slide far enough before taking hold of the lane, which results in too much hook or hooking or in an unpredictable and uncontrollable manner.

In addition, channels can form in the oil where the balls have travelled, causing uneven oiling and further inconsistencies in the manner in which the balls behave on the lane.

In the head area, the oil needs replenishing more often than in other portions of the lane because the balls tend to carry the oil out of that area and down the lane. Also, the ability of the oil to fill back in behind the ball and thereby prevent the formation of channels is particularly important in the head area.

At one time, conditioning oil was applied to bowling lanes with Hudson sprayers similar to the hand pumped pressurized sprayers used in gardening applications. However, those sprayers have not been available for years, and the oil is currently applied with machines having rollers which apply the oil to the lanes.

OBJECTS AND SUMMARY OF THE INVENTION

It is in general an object of the invention to provide a new and improved conditioning oil for use on bowling lanes.

Another object of the invention is to provide a conditioning oil of the above character which substantially eliminates the problems associated with the lane oils of the prior art.

These and other objects are achieved in accordance with the invention by providing a lane conditioning oil in an aerosol container which has a propellant for dispensing the oil through a spray nozzle in an aerosol form. The conditioning oil includes a mixture of mineral oil, a leveling agent, and an antistatic agent. The mineral oil is a combination of paraffin and petroleum based mineral oils, and in some embodiments, the mixture also includes isopropyl alcohol, a fluorescent whitening agent, and a lubricity agent.

BRIEF DESCRIPTION OF THE DRAWING

The single figure of drawing is an isometric view of one embodiment of an aerosol container of bowling lane conditioning oil incorporating invention.

DETAILED DESCRIPTION

The oil contains a mixture of mineral oil, a leveling agent, and an antistatic agent, with the mineral oil being a combination of paraffin and petroleum based mineral oils.

Approximately 75 to 85 percent of the mixture is a high grade paraffin mineral oil which is clear in appearance and serves as the base for the mixture. The paraffin oil is refined to eliminate long carbon chains and preferably has no more than about 20 to 30 carbon atoms per molecule.

A petroleum based mineral oil is combined with the paraffin oil and constitutes about 10 to 20 percent of the mixture. The petroleum based oil has a higher viscosity than the paraffin based oil and tends to adhere to the lanes somewhat better than the lighter paraffin oil. That is an important characteristic in preventing the oil from carrying down the lane with the ball. The heavier oil also provides better ball control and better ball action on the portion of the lane to which the oil is applied.

For greater quantities of oil and stronger oil ratio patterns (i.e., top hat condition), lower viscosity oils can be employed. For lower amounts of lane dressing and weaker oil pattern ratios, higher viscosities are used.

With some of the machines which are used for applying the oil to the lanes, it is desirable to include isopropyl alcohol in the mixture. Such machines have a wick of felt material which carries the oil from a trough to the roller which applies it to the lanes. The alcohol thins the oil so that it is better able to travel up the wick and onto the roller. Once the oil has been applied to the lanes, the alcohol evaporates or "flashes off" and does not affect the performance of the oil. Newer felt materials provide a better wicking action and may be able to carry the oil without the alcohol, in which case the alcohol can be eliminated from the mixture. The amount of isopropyl alcohol which is used is on the order of 0 to about 8 percent (by volume) of the mixture.

A fluorescent whitening agent is included in the mixture in order to meet the requirements of the American Bowling Congress. That agent enables lane men to check the thickness of the oil which has been applied to the lanes and to insure that it is within prescribed standards. The whitening agent constitutes about 0.03 percent (by volume) of the mixture.

In some applications, a lubricity agent composed of various hydrocarbon lubrication oils is included in the mixture to help the ball hold the lane better and to react better. In many applications, the lubricity agent is not required, in which case it can be omitted from the mixture. When included, the lubricity agent constitutes about 0.1 to 2.0 percent of the mixture.

A leveling agent is included in the mixture so that the oil on the lane will close behind the ball and remain level, rather than forming channels which could affect the action of subsequent balls. If the oil did not flow back, balls would begin hooking where they used to slide, and the ball action would be inconsistent. The leveling agent comprises on the order of about 0.1 to 2.0 percent (by volume) of the mixture. If too much leveling agent is used, the oil will tend to build up and splatter in front of the ball and be carried down the lane.

An antistatic agent is included in the mixture to prevent static buildup which can cause oil and dirt to adhere to the ball. The static tends to develop as the ball, which is typically made of a resin based material, travels over the oil and wood interface at the surface of the lane. The oil which adheres to the ball is carried down the lane, dust particles in the air are attracted to the ball, and the ball action becomes sluggish. By including the antistatic agent in the mixture, these problems are eliminated. The antistatic agent comprises about 0.1 to 2.0 percent (by volume) of the mixture.

EXAMPLE

A 500 gallon batch of the conditioning oil made in accordance with a presently preferred formulation contains the following mixture of ingredients:

- Paraffin mineral oil (402.77 gals)
- Petroleum mineral oil (61.96 gals)
- Isopropyl alcohol (30.98 gals)
- Fluorescent whitening agent (0.14 gal)
- Lubricity agents
  - Solvent dewaxed heavy paraffinic petroleum distillate (0.97 gal)
  - Hydrotreated heavy napthenic petroleum distillate (0.31 gal)
  - Calcium alkaryl sulfonate (0.03 gal)
  - Amine grafted ethylene/propylene copolymer (0.04 gal)
  - Zinc Dithiopthsphate (0.03 gal)
- Leveling agent
  - Akylsiloxane (1.3 gals)
- Antistatic Agents
  - Chloro-propyl-trimethoxy-silane (0.69 gal)
  - Methyl alcohol (0.69 gal)

All components are blended together thoroughly, e.g. by high speed agitation or in-line blending for a minimum of 45 minutes. Thorough blending is important for product uniformity and performance consistency.

The oil is typically applied to the lanes with machines which have troughs for holding the oil, rollers for applying the oil to the lanes, and felt wicks for carrying the oil from troughs to the rollers. Such machines are of conventional design and are well known to those familiar with the maintenance of bowling lanes.

Alternatively, the oil can be packaged in aerosol containers from which it can be sprayed onto the lanes. Such containers are particularly suitable for use in replenishing the oil in the head area where it needs replenishing more often than in other portions of the lanes.

As illustrated in FIG. 1, the oil is packaged in an aerosol container 11 together with a suitable propellant, with the oil being introduced into the container in the form of a liquid and the propellant being introduced as a compressed gas.

The propellant can be any suitable gas which does not react adversely with the lane oil, including hydrocarbons, nitrogen and air. One propellant which has been found to be particularly suitable for use with the oil is a hydrocarbon propellant commonly known as A-77, which contains a mixture of propane, isobutane and N-butane in the proportions (by volume) of 1,000 ppm propane, 800 ppm butane and 600 ppm N-butane. This mixture is introduced into the container at a pressure of 77 psi.

The container has a valve 12 of conventional design which includes a spray nozzle 13. When the valve is opened or depressed, the compressed gas expands through the valve and the spray nozzle, carrying the liquid conditioning oil with it. The oil is thus dispensed through the nozzle in a aerosol form in which liquid particles are suspended in the propellant gas.

The container is preferably made in a nonstandard size and/or shape in order to avoid confusion with approach cleaners or conditioners which are sometimes packaged in aerosol cans. In one preferred embodiment, the lane oil is packaged in a so-called "jumbo can" which is larger than the containers in which the other cleaners and conditioners are packaged. That will reduce the chances of someone inadvertently spraying lane oil onto the approach area or spraying approach area cleaner or conditioner onto the lane by mistake.

The invention has a number of important features and advantages. It provides consistent ball action and scoring, which are critical to good bowling. The ball slides down the lane without developing channels and without carrying the oil with it. Static buildup is eliminated, and there is no tendency for dirt and oil to adhere to the ball. This results not only in more consistent bowling but also in a significant increase in the cleanliness of the lanes. In addition, since the oil remains in place better than other oils, the time between oilings is reduced, and that has the additional advantages of reducing not only the cost of the materials and labor involved but also the time the lanes are out of service during conditioning.

Having the oil in an aerosol container makes it easier to apply the oil to the lanes, particularly in the head area where the oil requires more frequent replenishing. It is particularly convenient to apply the oil to the lanes on a regular basis with the machines and then replenish it as needed in the head area with an aerosol can between regular oilings.

The amount and location of the oil applied with an aerosol container can be directly observed, and it is an easy matter to touch up areas where lane oil conditions are poor or degrading. Such conditions can, for example, be caused by wearing parts, improper settings or inadequate maintenance of the machines which apply the oil.

When the oil is sprayed from an aerosol can, more air is entrapped in the oil. This gives the oil a greater lubricity and an even better ability to separate and fill in behind the ball. It also makes the oil livelier and more likely to hold up longer.

It is apparent from the foregoing that a new and improved conditioning oil for use on bowling lanes has been provided. While only certain presently preferred embodiments have been described in detail, as will be apparent to those familiar with the art, certain changes and modifications can be made without departing from the scope of the invention as defined by the following claims.

I claim:

1. A conditioner for use on bowling lanes, comprising: an aerosol container having a spray valve; a conditioning oil in the container comprising a mixture of mineral oil, a leveling agent and an antistatic agent; and a propellant in the container for dispensing the oil mixture through the spray valve in an aerosol form.

2. The conditioner of claim 1 wherein the mineral oil, leveling agent and antistatic agent are present in a volumetric ratio on the order of 85–105 parts mineral oil, 0.1–2.0 parts leveling agent, and 0.1–2.0 parts antistatic agent.

3. The conditioner of claim 1 wherein the mineral oil includes a paraffin based mineral oil and a petroleum based mineral oil.

4. The conditioner of claim 3 wherein the mineral oil, leveling agent and antistatic agent are present in a volumetric ratio on the order of 75–85 parts paraffin based mineral oil, 10–20 parts petroleum based mineral oil, 0.1–2.0 parts leveling agent, and 0.1–2.0 parts antistatic agent.

5. The conditioner of claim 1 wherein the propellant is a compressed gas.

6. The conditioner of claim 1 wherein the propellant is a hydrocarbon.

7. The conditioner of claim 1 wherein the mixture further includes a fluorescent whitening agent.

8. The conditioner of claim 5 wherein the whitening agent is present in an amount on the order of 0.03 percent by volume of the mixture.

9. The conditioner of claim 1 wherein the mixture further includes a lubricity agent.

10. The conditioner of claim 9 wherein the lubricity agent is present in an amount on the order of 0.1–2.0 percent by volume of the mixture.

11. The conditioner of claim 9 wherein the lubricity agent contains a solvent dewaxed heavy paraffinic petroleum distillate, a hydrotreated heavy napthenic petroleum distillate, a calcium alkaryl sulfonate, an amine grafted ethylene/propylene copolymer, and zinc dithiopthsphate.

12. The conditioner of claim 1 wherein the antistatic agent contains chloropropyl-trimethoxy-silane and methyl alcohol.

13. A conditioner for use on bowling lanes, comprising: an aerosol container having a spray valve; a bowling lane conditioning oil which is introduced into the container in a liquid form, and a compressed propellant gas in the container for dispensing the oil mixture through the valve in an aerosol form.

14. A conditioner for use on bowling lanes, comprising: an aerosol container having a spray valve; a conditioning oil in the container consisting essentially of 75–85 parts paraffin based mineral oil, 10–20 parts petroleum based mineral oil, 0.1–2.0 parts leveling agent, and 0.1–2.0 parts antistatic agent; and a propellant in the container for dispensing the conditioning oil through the spray valve in an aerosol form.

15. The conditioner of claim 14 further including 0.03 part fluorescent whitening agent.

16. The conditioner of claim 14 further including 0.1–2.0 parts lubricity agent.

17. The conditioner of claim 16 wherein the lubricity agent contains a solvent dewaxed heavy paraffinic petroleum distillate, a hydrotreated heavy napthenic petroleum distillate, a calcium alkaryl sulfonate, an amine grafted ethylene/propylene copolymer, and zinc dithiopthsphate.

18. The conditioner of claim 14 wherein the antistatic agent contains on the order of 50 percent chloro-propyl-trimethoxy-silane and 50 percent methyl alcohol.

* * * * *